United States Patent [19]

Touze

[11] 4,202,060

[45] May 13, 1980

[54] OPENABLE BATH

[76] Inventor: Pierre Touze, 11, Rue G. Faussart, 92150 Suresnes, France

[21] Appl. No.: 941,078

[22] Filed: Sep. 11, 1978

[30] Foreign Application Priority Data

Sep. 15, 1977 [FR] France ..... 77 27947

[51] Int. Cl.[2] ..... A47K 3/02

[52] U.S. Cl. ..... 4/173 R

[58] Field of Search ..... 4/173 R, 182, 179, 175, 4/192; 251/321, 320, 319

[56] References Cited

U.S. PATENT DOCUMENTS

| | | | |
|---|---|---|---|
| 1,948,062 | 2/1934 | Brunette | 251/321 |
| 2,991,482 | 7/1961 | Brass | 4/173 R |
| 3,371,354 | 3/1968 | Hayslett | 4/173 R |

*Primary Examiner*—Lenard A. Footland

*Attorney, Agent, or Firm*—Owen, Wickersham & Erickson

[57] ABSTRACT

An openable bath, principally for baths for elderly or handicapped persons, is made up of two parts 2, 3 one of which can pivot with respect to the other about a vertical axis. The fixed part 2 of the bath body 1 includes a stopcock assembly 21 governed by a push member activated by closure of the bath to stop the water supply to the bath tap assembly 9 unless there is complete closure of the bath, and the movable part 3 includes a float device 23 which bolts the closure device 5 in the closed position as long as the bath contains water.

7 Claims, 4 Drawing Figures

OPENABLE BATH

The present invention relates to a bath intended in particular for the use of elderly or handicapped persons.

The use of conventional baths is difficult for elderly or handicapped persons in that it is hard for such persons to get into or out of the bath unassisted. In fact, if the bath projects above the floor, it is necessary to step over the side of the bath; if the bath is recessed into the floor, it is necessary to stoop and to straighten up, to overcome the difference in level between the floor and the bottom of the bath.

Both classes involve movements of a substantial amplitude which elderly or handicapped persons are often not able to carry out alone, or at least without the aid of another person.

The present invention seeks to provide a bath which can be used without difficulty, in particular by elderly or handicapped persons. The bath in accordance with the invention is an openable bath comprising a fixed part and a movable part which can be pivoted with respect to the fixed part about a substantially vertical pivotal axis located on one side of the bath. When the bath has been opened by pivoting the movable part, an elderly or handicapped person can then enter and leave it without difficulty since the bottom of the bath is only a small distance above the floor and there is no edge to step over.

The vertical plane of section of the bath into a fixed part and a movable part is preferably transverse to the length of the bath and passes through the deepest part of the body of the bath.

In order to prevent the accidental introduction of water into the bath from the bath taps when the bath is open or incompletely closed on the one hand, and on the other hand to prevent the bath's being opened while it still contains water, the openable bath according to the invention preferably comprises a filling security device which prevents the filling of the bath when the latter is incompletely closed, and a closure security device which prevents the bath's being opened while it contains water.

According to one embodiment of the invention, the filling security device includes a feeler, operated by the complete closure of the bath, to turn on the water supply to a set of bath taps. When the bath is incompletely closed, this feeler completely prevents access of water to the bath taps.

The said feeler can advantageously comprise a spring-loaded push member projecting above the contact surface of one of the two parts of the bath with the other part. This push member operates on a stopcock mounted upstream of the bath taps and controlling the access of cold and hot water to said taps.

For preference the said push member is mounted in the vicinity of the side of the bath opposite the pivoting axis.

The closure security device of the bath comprises means co-operating with the closure device of the bath maintaining the latter device in a closed position as long as the bath contains water.

The said means comprise for preference a horizontal hasp movable in a horizontal plane and having a hole for receiving a vertical pin connected to a float located in a vertical chamber communicating with the interior of the bath.

The closure device of the bath advantageously comprises at least one catch of the knee-joint type, the lever of which pivots about a vertical axis. The said hasp is then rigidly attached to this lever.

It is preferred that the knee-joint type catches are at least two in number, and that their levers are connected together by a vertical bar. The said hasp is then advantageously formed by the bent upper end of this bar, and the handle is fixed to this bar.

Referring now to the attached drawings, there will be hereinafter described in greater detail an illustrative non-limiting embodiment of a bath according to the invention; in these drawings FIG. 1 is a plan view of a bath according to the invention in the closed condition;

Figure 1:
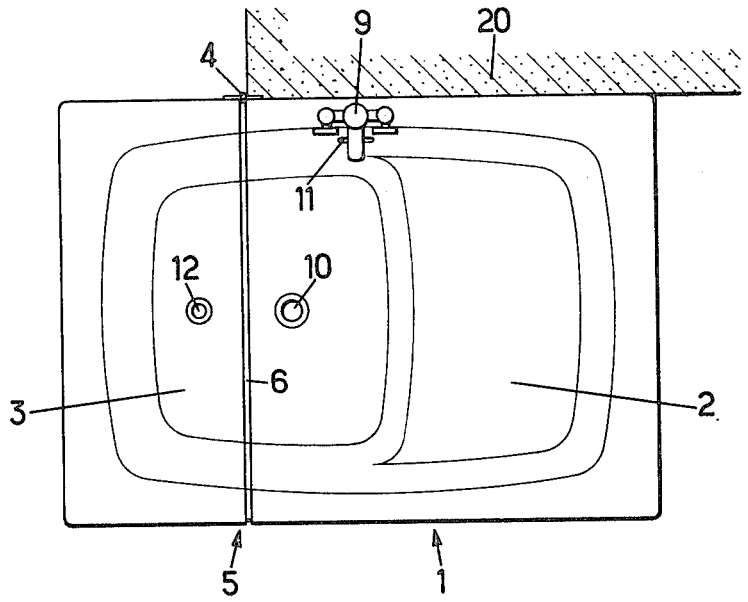

The openable bath illustrated in the drawings is a sitz-bath or a foot-bath, the body 1 of which is of conventional shape and divided into two parts 2, 3. The plane of section is vertical and transverse to the length of the bath and passes through the deepest part of the body of the bath 1 (see FIG. 3). The movable part 3 is connected to the fixed part 2 by a vertical pivotal axis 4 located on one side of the body of the bath 1. A closure device 5 described in more detail hereunder is provided on the opposite side of the body of the bath 1. The water-tightness of the body of the bath 1 in the closed condition is ensured by a seal 6, for example of foam rubber, which is compressed at the time of closure of the body of the bath 1 by means of the device 5. The seal 6 is fixed, for example by glueing, upon a reinforcement 7 provided on the part 2 of the body of the bath 1, around the sides and the bottom. The part 3 bears a corresponding reinforcement 8. These reinforcements are intended to provide the two parts 2 and 3 with a satisfactorily large contact surface, and they comprise wooden frames in the example shown.

It will be remembered that the bath is filled by means of a mixer tap 9 of the conventional wall type and that the part 2 of the body of the bath 1 is equipped with a plug-hole 10 having an overflow 11. The part 3 comprises an extra outlet 12 whose function is described later.

The fixed part 2 of the body of the bath 1 rests on the ground through its reinforcement 7 and feet 13, whereas the moving part 3 whose reinforcement 8 does not reach the ground carries a castor 14 compensating for the cantilever during pivoting of the part 3.

Figure 3:
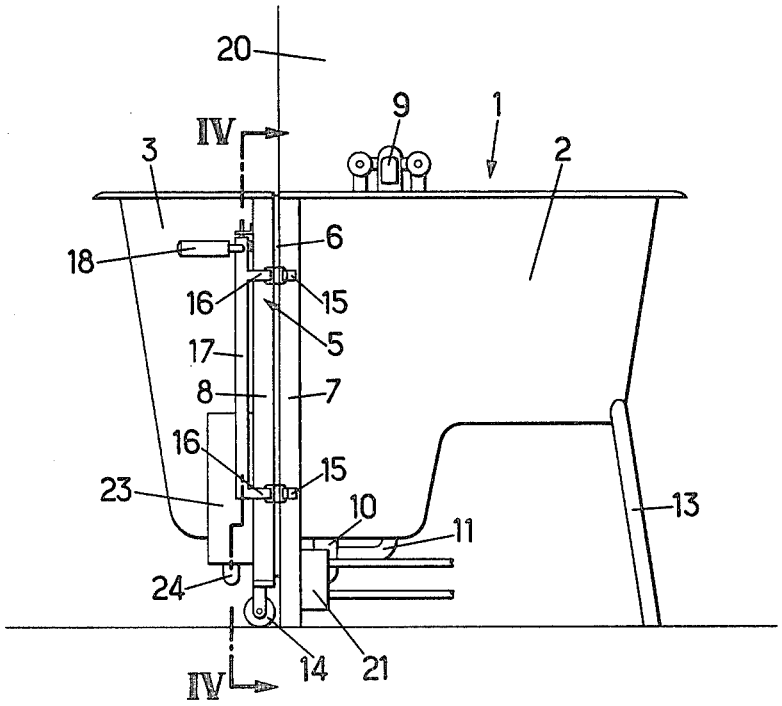
FIG. 3 is a side elevation of the bath of FIG. 1.

As shown in detail in FIG. 3, the closure device 5 of the bath consists of two catches of knee-joint type, placed one above the other, of which the receivers 15 are fixed to the reinforcement 7 of the fixed part 2 of the body of the bath, and of which the levers 16 are connected to the reinforcement 8 of the moving part 3 so as to be pivotable about a vertical axis. To facilitate the manual operation of the two catches, their levers 16 are connected together by a vertical bar 17 having a handle 18 at the upper portion thereof.

Figure 2:
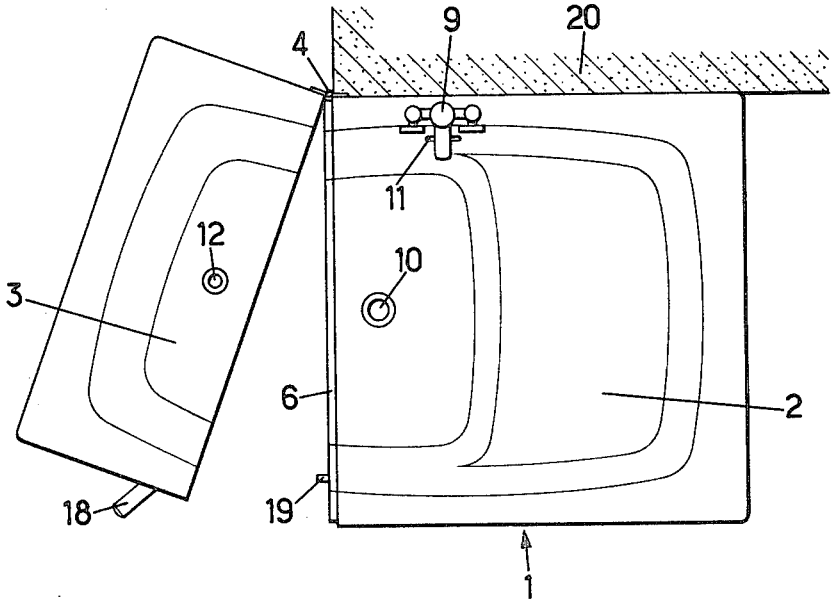
FIG. 2 is a plan view of the bath of FIG. 1 in the open condition.

As shown in FIG. 2 a spring-loaded push member 19 is provided projecting from the reinforcement 7 of the fixed part 2 in the direction of the reinforcement 8 of the movable part 3, to prevent filling of the bath when the latter is incompletely closed. This push member 19 acts on a double stopcock 21 installed upstream of the bath tap assembly 9 and fixed to the reinforcement 7. The stopcock assembly 21 comprises two coupled valves, one for governing the supply of hot water and the other the supply of cold water to the bath tap assembly 9. Whenever the bath is incompletely closed, the push member 19 projects beyond the reinforcement 7 and the two coupled valves of the stopcock assembly 21 are closed, so that it is not possible to run water from the bath tap assembly 9. It is not until the bath is completely closed, that is to say until the movable part 3 is pressed the fixed part 2 by the closure effect of the catches of the closure device 5, the sealing member 16 being compressed, that the push member 19, forced against the reinforcement 8 of the moving part 3, is depressed, against its spring loading, within the reinforcement 7 of the fixed part 2, and thus opens the two coupled valves of the stopcock assembly 21. The latter thus releases the hot and cold water to the bath tap assembly 9.

To improve the sensitivity of the push member 19, that is to say to make absolutely certain that the latter does not open the stopcock assembly 21 except when the bath is completely closed, it is advantageous to place the push member 19 at the opposite side of the bath to the pivot axis 4.

Figure 4:
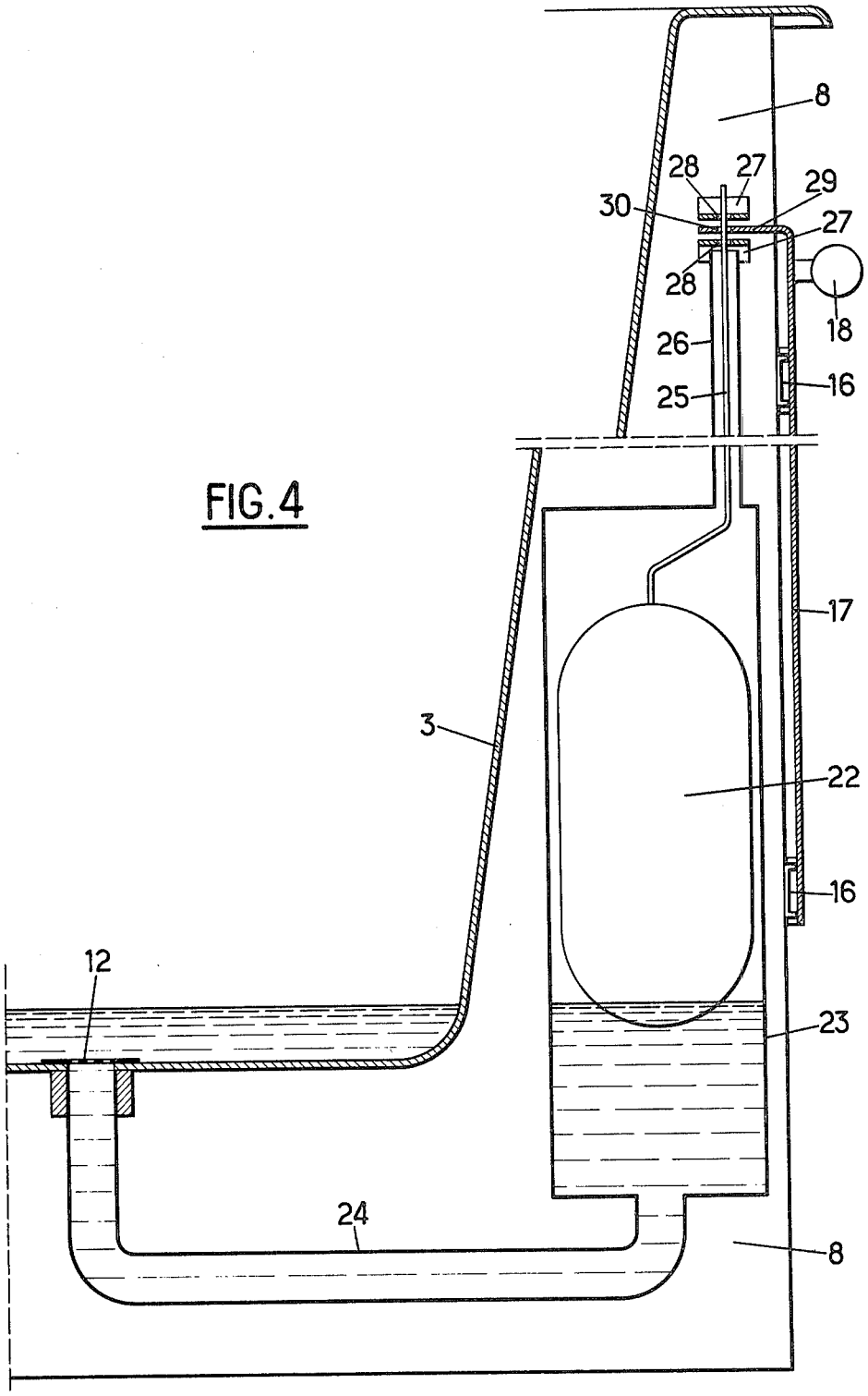
FIG. 4 is a partial section on a larger scale, along the line IV—IV of FIG. 3.

A security device co-operating with the closure device 5 is provided to prevent the bath being opened while it contains water. This security device, which can be seen especially in FIG. 4, comprises a float 22 located in a vertical chamber 23, placed to one side of the movable part 3 of the bath body 1. The open lower end of the chamber 23 communicates with the extra outlet 12 by means of a conduit 24 which passes beneath the bottom of the movable part 3. Thus, the water contained in the bath passes, in accordance with the principle of communicating vessels, through the conduit 24 into the chamber 23 and lifts the float 22. The latter is surmounted by a vertical rod 25 which slides freely in a vertical guide tube 26 which is an upward extension of the vessel 23. The vessel 23 with its guide tube 26 is fixed to the reinforcement 8 of the movable part 3, in such a way that the tube 26 and likewise the rod 25 which it contains, are located only a small distance from the reinforcement 8. The latter bears, close above the upper end of the guide tube 26, two angle sections 27 whose projecting webs are horizontal and are spaced apart vertically. The projecting web of each section 27 is pierced by a hole of diameter greater than the diameter of the rod 25. The holes of the two angle sections 27 are aligned with the axis of the rod 25.

The vertical bar 17 connecting together the levers 16 of the two catches of the closure device 5 of the bath is bent at right angles at its upper end to form a horizontal hasp 29 pierced with a hole 30 of a diameter greater than the diameter of the rod 25. The position of the pivotal axis of the bar 17 in relation to the axis of the rod 25 and that of the hole 30 are chosen in such a manner that in the closed condition of the closure device 5, the axis of the hole 30 of the hasp 29 situated between the projecting webs of the angle sections 27, is aligned with the axis of the rod 25.

Thus, as soon as the closed bath begins to be filled with water, the float 22 is lifted so that the rod 25 passes simultaneously through the holes 28 of the projecting webs of the angle sections 27 and the hole 30 of the hasp 29, so that the latter is bolted in position, and so that as a result the closure catches cannot be opened by an untimely actuation of the handle 18. The height of the float 22 and of the rod 25 is chosen in such manner that the arms 29 remains locked by the rod 25 until after the complete emptying of the bath.

It goes without saying that many modifications and variations can be applied to the bath described above, and illustrated in the attached drawings, without departing from the scope of the present invention. Thus the bath could equally well be a flat-bottomed type, although a sitz-bath or foot-bath is more convenient for elderly or handicapped persons.

The plane of section of the bath body could equally be situated closer to one end of the bath permitting the necessary recess in the wall 20 for pivoting the movable part to be reduced in depth.

The reinforcements provided on the two parts of the bath body on both sides of the plane of section may comprise edges which form an integral part of the two parts of the bath body, instead of comprising matching frames of wood. In this case, round holes can be provided in the edge of one of the parts of the bath, preferably in the movable part, the water tight seal in moulded rubber having a corresponding number of projections capable of elastic engagement in these holes under light pressure.

Finally, instead of being formed of two catches of the knee-joint type, the closure device of the bath could comprise different elements, on condition that the latter give the necessary tightening for compressing the water-tight seal.

The bath is represented in the raw condition in the drawing, but can be finished in conventional manner by means of a vanitory top under the edges shown, can be made in any usual bath material, for example cast metal, sheet metal or plastics material, although it is advantageous to choose a light material so as to facilitate pivoting of the movable part and to avoid the necessity for excessive effort applied to the pivotal axis of the latter.

I claim:

1. An openable bath for the use in particular of elderly or handicapped persons, comprising:

a bath tub dimensionally greater in a longitudinal direction than in a transverse direction and divided in between its two longitudinal ends along a transverse vertical plane passing substantially through the deepest part of the bath tub into a fixed tub part and a movable tub part pivoted to the fixed part about a vertical pivotal axis located on one longitudinal side of the bath tub, a compressible seal extending around the two sides and the bottom of one of said two parts in the contact plane of said two parts, closure means located on the longitudinal side of the bath tub opposite to that of said pivotal axis for urging a contact surface of said movable part against a contact surface of said fixed part while compressing said seal, said tub parts then defining a bathing interior, a closure security device including locking means governed by a float responsive to the water level in the bath tub for locking the closure device in a closed position and holdng it locked while the bath tub contains water, a bath tap assembly for directly filling the bath tub with water, and filling security means for preventing the supply of water to said bath tap assembly when said bath tub is not completely closed.

2. A bath according to claim 1, wherein said filling security means includes a feeler responsive to complete closure of the bath tub, said feeler being located on the longitudinal side of the bath tub opposite to said pivotal axis and a stopcock assembly actuated by said feeler and mounted upstream of said bath tap assembly.

3. A bath according to claim 1, wherein said filling security means includes a push member projecting under spring load, from the contact surface of one of the two parts of the bath tub with the other on the longitudinal side of the bath tub opposite to said pivotal axis and a stopcock assembly actuated by said push member and mounted upstream of said bath tap assembly.

4. A bath according to claim 1, wherein said float is located in a vertical chamber defined by one part of said tub and communicating with the bathing interior of the bath tub according to the principle of communicating vessels.

5. A bath according to claim 1, wherein said locking means governed by the float include two vertically spaced apart fixed horizontal hasps, each fixedly attached to one of the two parts of the bath, said hasps having two aligned holes, one through each of said hasps, one movable horizontal hasp connected to the bath closure device so as to be movable in a horizontal plane between said two fixed hasps, said movable hasp likewise having a hole therethrough alignable with said two aligned holes, and a vertical rod attached to the float and passing through the aligned holes of the said three hasps only when the closure device is in its closed position and the float is elevated by the rise of the water level in the bath tub.

6. A bath according to claim 5 wherein the closure device includes at least one catch of the knee-joint type, the lever of which can pivot about a vertical axis, said movable hasp being solid with said lever.

7. A bath according to claim 6, wherein the levers of the knee-joint type catches are connected together by a vertical bar, and said movable hasp is formed by a bent upper end of said bar, and an operating handle fixed to said bar.

* * * * *